US006761650B1

(12) United States Patent
Dettmann

(10) Patent No.: US 6,761,650 B1
(45) Date of Patent: Jul. 13, 2004

(54) FOOTBALL TRAINING APPARATUS

(75) Inventor: John E. Dettmann, Madison, WI (US)

(73) Assignee: Helgesen Industries, Inc., Hartford, WI (US)

( * ) Notice: Subject to any disclaimer, the term of this patent is extended or adjusted under 35 U.S.C. 154(b) by 0 days.

(21) Appl. No.: 10/096,523

(22) Filed: Mar. 11, 2002

(51) Int. Cl.[7] ..... A63B 69/34
(52) U.S. Cl. ..... 473/445; 473/441
(58) Field of Search ..... 473/445, 441, 473/422, 438, 443, 444, 442, FOR 124, FOR 125

(56) References Cited

U.S. PATENT DOCUMENTS

| | | | | | |
|---|---|---|---|---|---|
| 3,062,548 | A | * | 11/1962 | Foster et al. | 473/445 |
| 3,825,260 | A | * | 7/1974 | Thomas | 473/444 |
| 3,997,160 | A | * | 12/1976 | George | 473/444 |
| 4,140,315 | A | * | 2/1979 | Page, Jr. | 473/445 |
| 4,802,670 | A | | 2/1989 | Smith | |
| 5,462,272 | A | | 10/1995 | Staten | |
| 5,743,821 | A | * | 4/1998 | Wirachowski | 473/441 |

OTHER PUBLICATIONS

Austin Sporting Goods, Super Leg Drive and Leg Drive Machine, Advertising Materials.

Marty Gilman, Inc., Gilman Gear, Football Field Equipment, Sleds, printed from www.gilmangear.com internet web site on Feb. 18, 2002.

* cited by examiner

*Primary Examiner*—Stephen P. Garbe
*Assistant Examiner*—M. Chambers
(74) *Attorney, Agent, or Firm*—Reinhart Boerner Van Deuren s.c.

(57) ABSTRACT

A football training apparatus provides for simultaneous strength and technique training to improve player strength as applied functionally to blocking. A frame structure includes left and right movable arms with strike pads mounted on the distal ends thereof The height of the strike pads is adjustable for differently sized players. A variable resistance mechanism provides a quantitative resistance to rearward movement of the arms. The frame structure is mounted on left and right rear wheels. When the left and right strike pads are driven rearward a sufficient distance a brake actuator mechanism is engaged to release independently operable brake mechanisms in the left and right rear wheels, respectively. Handles, with hand brake release mechanisms, may be provided on the rear end of the frame structure to allow the apparatus to be pushed without engaging the strike pads.

28 Claims, 6 Drawing Sheets

FOOTBALL TRAINING APPARATUS

FIELD OF THE INVENTION

The present invention pertains generally to equipment for training football players, and more particularly to equipment for increasing a football player's strength while also improving the player's functional technique, e.g., in blocking.

BACKGROUND OF THE INVENTION

Successful players of American style football possess at least two important characteristics, physical strength and endurance, and highly developed functional skills and techniques for applying such strength and endurance to particular game situations and positions. For example, for a lineman, such as an offensive lineman, strength and endurance is required to block opposing players of similar size and strength repeatedly play after play. A finely honed functional technique is required to ensure that the lineman's strength is applied properly so that the opposing player does not slip or evade the block or such that the block does not result in a penalty such as for holding. Thus, in training football players, such as lineman, it is important to develop both strength and endurance as well as functional playing technique.

For the most part, a football player's strength and endurance and playing technique have been developed and trained separately. For example, strength and endurance can be gained in the weight room, by weight training using, e.g., free weights or other strength building equipment. Weight training can be very effective for the player in gaining raw strength and endurance. Furthermore, such weight training is measurable. A coach or trainer can easily see that a player is gaining strength and endurance as the player is able, for example, to press more weight for more repetitions.

The functional aspects of play, i.e., the application of raw strength and endurance to particular skills and techniques, may be learned in practice through game play and practice scrimmages, that is, through live practice. However, such live practice is naturally limited to specific practice times when skilled coaches and other players are available. Furthermore, rules in some leagues limit the numbers of such practices. Moreover, there is a significant risk of injury in any live practice situation. For these reasons, the use of live practice to enhance a football player's functional technique is often very limited.

As a supplement to live practice situations, various types of football training equipment have been developed and used to allow players to practice their techniques without facing off against another live player and, in some cases, even without the need for the presence of a coach or trainer. A common example of such training equipment is the conventional football training sled for teaching functional techniques such as tackling and blocking. A typical football training sled includes a horizontal base including one or more sled like runners, and a padded vertical extension mounted at one end of the sled base. The padded portion of the sled may be sized and shaped to represent an opposing player. A lineman may practice blocking techniques, for example, by blocking against the padded portion of the sled, driving the sled straight backward as he would an opposing player. Weight may be added to the sled to increase the effort required to drive the imitated opposing player back off the line. Some more advanced training sleds include a mechanism which allows a player both to drive the sled backward and to lift the padded portion of the sled without lifting the entire sled. This simulates player hip rotation which converts the horizontal movement generated forwardly by the player into a force with a vertical component which tends to lift the opposing player so as to render him momentarily helpless. In at least one such training sled the padded portion of the sled is mounted on a telescoping arm. A mechanism is provided which prevents rotation of the blocking pad upward unless the pad mounted on the telescoping arm has been driven rearward by a sufficient amount. Spring resistance provides resistance to rearward movement of the arm. See U.S. Pat. No. 5,462,272.

Typical football training equipment, such as training sleds, are used as tools for training and practicing functional technique, such as blocking, but do relatively little to increase strength and endurance in the particular functional application being taught or practiced. Furthermore, such training equipment is a tool for qualitative training only. With the use of such equipment, a coach or trainer can observe a player's technique and instruct him in required corrections and adjustments thereto. Such equipment does not provide for a quantitative measure of the effective application of the player's strength and endurance to the particular functional technique being taught in practice.

What is desired, therefore, is a football training apparatus that provides simultaneously for developing both a player's strength and functional technique in a manner such that the strength gain is both general in nature and concentrated as applied to the particular functional skills required of the player. Such a functional strength machine for football player training should provide for the quantitative enhancement of both the football player's strength and technique, e.g., in blocking, with or without the need for a coach. Such a football training apparatus should be usable both indoors and outdoors, and should be adjustable to accommodate players of various sizes, strengths, and skill levels.

SUMMARY OF THE INVENTION

The present invention provides a football training apparatus which may be used as a functional strength machine. A football training apparatus in accordance with the present invention allows a football player to develop his strength in a functional manner, such that physical strength is increased both generally and in a focused manner with regard to the particular functional technique to which the player's strength must be applied in a game situation. In particular, the present invention provides a football training apparatus which allows a lineman to develop and enhance his strength as applied functionally to blocking technique. A football training apparatus in accordance with the present invention may be used indoors and outdoors on all types of surfaces, with or without a coach or trainer. More than one player may use the apparatus simultaneously to practice combo or deuce blocking techniques. A football training apparatus in accordance with the present invention is adjustable for variously sized players, for players of different skill and ability levels, and to increase the strength required to be exerted by a player during the performance of a particular blocking technique using the apparatus as the player's strength increases. A football training apparatus in accordance with the present invention thus provides for a quantitative measure of the increase in a player's strength and ability, not just generally, but as applied functionally to a particular skill, e.g., blocking.

A football training apparatus in accordance with the present invention includes a frame structure including a horizontally oriented base and a vertically extending portion formed at a front end of the frame base and extending generally vertically therefrom. The entire frame structure is preferably made of a structurally strong and durable material, such as steel, which is preferably welded and/or bolted together with sufficient cross pieces to form a sturdy frame structure. The vertically extending portion of the frame structure preferably extends from the front end of the horizontal base at a slight angle thereto, such that the vertically extending portion of the frame also extends slightly forward from the front end of the horizontal base.

The frame is preferably supported on wheels, e.g., wheels are preferably provided at each of the four corners of the horizontal base. For example, caster wheels maybe provided at the front ends of the horizontal base, below the vertically extending portion of the frame structure, with larger treaded wheels provided at the rear of the base of the frame structure. The rear wheels of the apparatus are provided with independently operable braking mechanisms, such that the rear wheels are normally locked into position when the brake mechanisms are engaged, and the rear wheels are allowed to rotate freely when the brake mechanisms are released. For example, each of the rear wheels may be mounted on a drum, with movable brake pads mounted within the drum to engage the inner surface of the drum to prevent movement of the wheels when the brake mechanism is engaged. Other braking mechanisms, such as a disc brake system, may also be employed.

An actuator system assembly is mounted on the vertically extending portion of the football training apparatus frame structure. The actuator system assembly includes a support structure by which the actuator system assembly is mounted to the vertically extending portion of the frame structure. The actuator system support structure is preferably adapted to be secured to the vertically extending portion of the frame structure in various user adjustable positions, thereby to allow the height of the actuator system with respect to the frame to be adjusted for players of various sizes. Two parallel extending arms are mounted onto the support structure such that the arms extend forward from the apparatus in an extended direction and may be pushed backward in the direction of the apparatus in a retracted direction.

Padded strike pads are mounted at the forward distal ends of the extending arms. The strike pads are preferably sized and shaped to represent an opposing football player. For example, a strike pad mounted on the left extending arm maybe sized and shaped to mimic one half of the torso of an opposing lineman, with the strike pad mounted on the right extending arm sized and shaped to mimic the other half torso of an opposing lineman. The extending arms are positioned closely adjacent and parallel to each other such that the strike pads together mimic the torso and shoulders of an opposing football player. The strike pads may preferably be mounted to the forward distal ends of the extending arms so as to be rotatable within a limited range about a horizontal axis. The strike pads are thus able to tilt when struck to drive the extending arms rearward, thereby simulating a player gaining leverage over an opponent.

The extending arms are mounted within the actuator system assembly so as to be movable backward and forward, i.e., retracted and extended therein. This may be achieved by supporting the extending arms on rollers which, in turn, are mounted on the actuator system support structure. The rollers support the extending arms to provide smooth movement of the extending arms between the extended and retracted positions thereof.

A resistance mechanism is provided which biases the extending arms forward toward the extended position thereof and which resists movement of the extending arms in the rearward retracted direction. Preferably, the resistance mechanism is adjustable to allow for adjustment of the force required to drive the extending arms rearward. The resistance force required to drive the extending arms rearward is also preferably independently adjustable via the resistance mechanism for each of the right and left extending arms. The extending arm resistance mechanism may be implemented, for example, using elastic tension bands or cords extending between the rear ends of the extending arms, opposite the ends thereof to which the strike pads are attached, and the actuator system assembly support structure. By selecting the number (or resistance) of cords attached to the extending arms, the resistance force required to drive the extending arms rearward can be adjusted. Other extending arm resistance structures employing e.g., springs, pneumatics, etc. might also be employed.

The actuator system assembly also includes a brake actuation mechanism. The brake actuation mechanism is engaged when the extending arms are driven rearward by at least a selected amount. Independent right and left brake actuation mechanisms are preferably provided in association with the right and left extending arms, respectively, and are coupled to the corresponding brake mechanisms in the right and left rear wheels attached to the horizontal base frame structure of the apparatus. In accordance with the present invention, the brake mechanisms in the rear wheels are normally engaged, preventing movement of the football training apparatus, until the extending arms are driven rearward by a sufficient amount, by a football player pressing against the strike pads, to engage the brake actuation mechanisms provided in the actuator system assembly.

The brake actuation mechanism may, for example, be implemented using a brake actuation lever mounted to the actuator system support structure. The brake actuation lever is mounted to the support structure in a position thereon such that the lever is engaged by a back side of a strike pad when the extending arm on which the strike pad is mounted it is driven into the fully retracted position, against the resistance provided, e.g., by the elastic tension cords attached thereto. The brake actuation lever is movably, e.g., rotatably, mounted on the actuation system assembly support structure such that the lever is rotated about a pivot point when the back side of the strike pad contacts the brake actuation lever. The brake actuation lever is coupled to the brake mechanism formed in the rear wheel of the training apparatus by, e.g., a brake cable. When the brake actuation lever is engaged by the back side of the strike pad, the resulting rotational movement of the brake lever pulls on the brake cable, thereby disengaging the normally engaged brake mechanism, allowing movement of the corresponding rear wheel.

Preferably, separate brake levers are provided in association with each of the right and left strike pads and corresponding extending arms, with each such brake actuator lever coupled by a corresponding brake cable to the corresponding braking mechanism in the corresponding rear wheel of the football training apparatus. Thus, in order for both rear wheels to be released for movement, both strike pads must be driven rearward against the restraining force of the resistance mechanism to engage both of the brake actuator levers. If neither brake actuator lever is engaged, the training apparatus will not move. If only one of the brake actuator levers is engaged, only one of the rear wheels will be released, and the football training apparatus will rotate away from the player striking the strike pads. This simulates an opposing player evading a block which is not well centered or evenly applied. Thus, a football player using a football training apparatus in accordance with the present invention is able to improve blocking technique while increasing strength functionally, that is, as applied to blocking.

Combo or deuce blocking techniques, wherein two linemen combine efforts to block an opposing player, can be performed and practiced using a football training apparatus in accordance with the present invention. To practice such a maneuver, each practicing player engages one of the strike pads. The football training apparatus of the present invention teaches accurate synchronization of such a maneuver, in that the apparatus will move straight backward only if both rear brake mechanisms are released by the players driving both the right and left strike pads rearward with sufficient strength and proper coordination in time.

A football training apparatus in accordance with the present invention may further include a secondary brake release mechanism. The secondary brake release mechanism may be implemented as a hand brake release mounted, e.g., on a handle extending vertically upward from a rear of the base portion of the training apparatus frame structure, i.e., on the opposite side of the frame structure from the vertically extending portion thereof to which the actuator system assembly is mounted. Separate hand brake release mechanisms, mounted on separate rear handles, positioned side by side, may be provided for release of the brake mechanisms provided in each of the rear wheels of the football training apparatus. Each of the hand brake release mechanisms may be coupled by a brake cable to the corresponding brake mechanism. Thus, in accordance with the present invention, the brake mechanism in each rear wheel of the football training apparatus may be released alternatively by a player or players driving the strike pads positioned at the front of the training apparatus backward on the extending arms or by a coach or trainer positioned behind the football training apparatus and operating the hand brake release mechanisms. Thus, the coach or trainer may control release of the brake mechanisms to simulate various opposing player responses to a block. Alternatively, a player positioned behind the football training apparatus may disengage the rear wheel brakes using the hand brake release mechanisms in order to push the entire football training apparatus using the rear handles on which the hand brake release mechanisms are mounted. This allows the football training apparatus of the present invention to be used as a strength and speed developer without engaging the strike pads on the front of the machine.

Preferably, one or more vertical stanchions are provided on the horizontal base frame structure of the football training apparatus. The stanchions provide support for one or more conventional weight plates which may be loaded on the frame structure to increase the weight of the apparatus. Additional weight plates can be added to or removed from the frame to accommodate athletes of various strength levels for the pushing exercises, and to simulate opposing linemen of various sizes.

Further objects, features, and advantages of the invention will be apparent from the following detailed description taken in conjunction with the accompanying drawings.

DETAILED DESCRIPTION OF THE INVENTION

Figure 1:
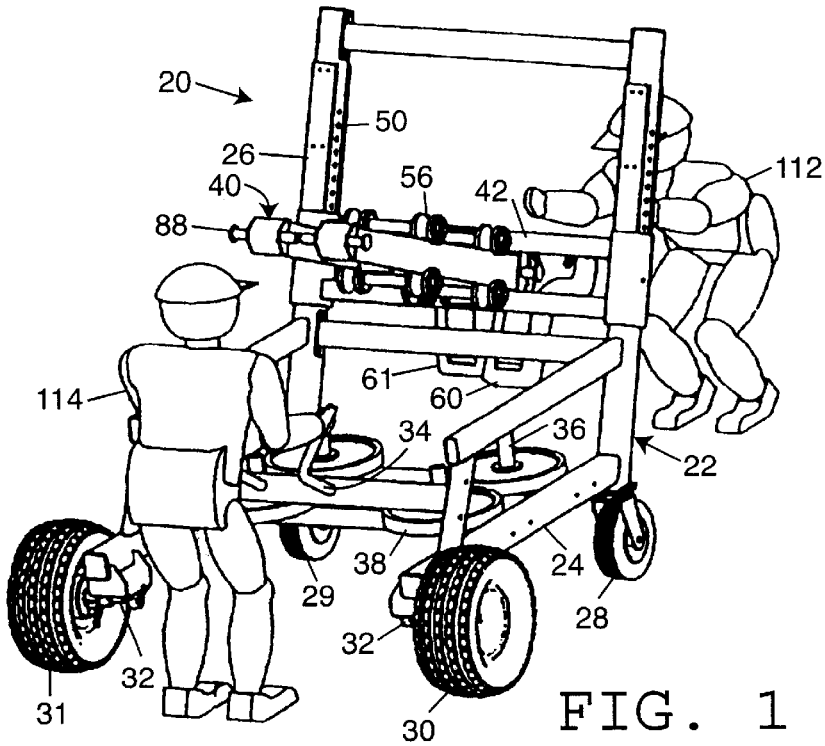
FIG. 1 is a rear perspective view of an exemplary football training apparatus in accordance with the present invention, with some detail removed.
Figure 2:
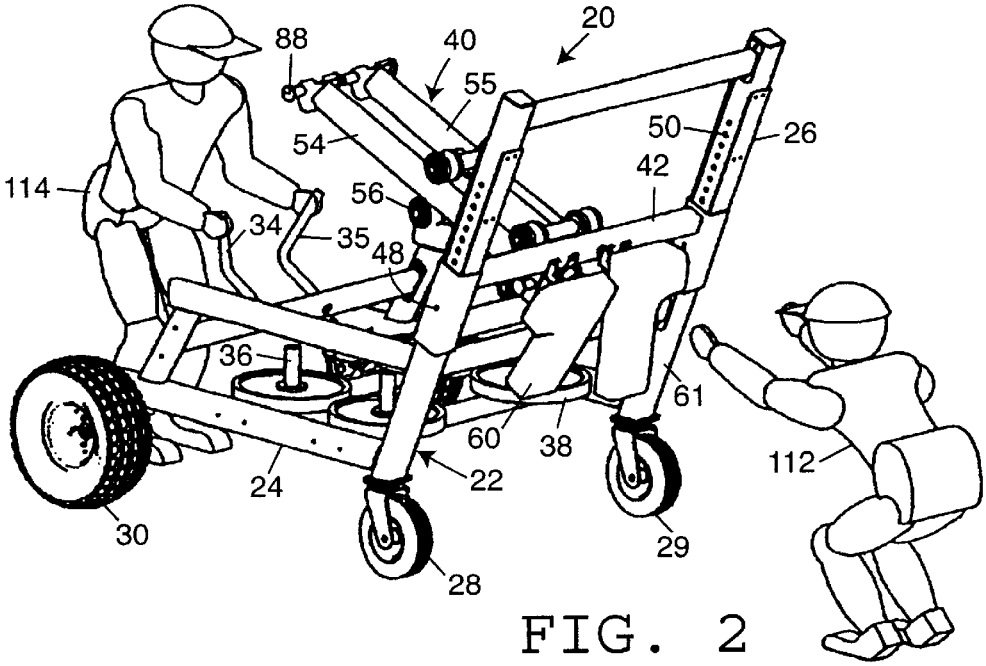
FIG. 2 is a front perspective view of the exemplary football training apparatus of FIG. 1.
Figure 3:
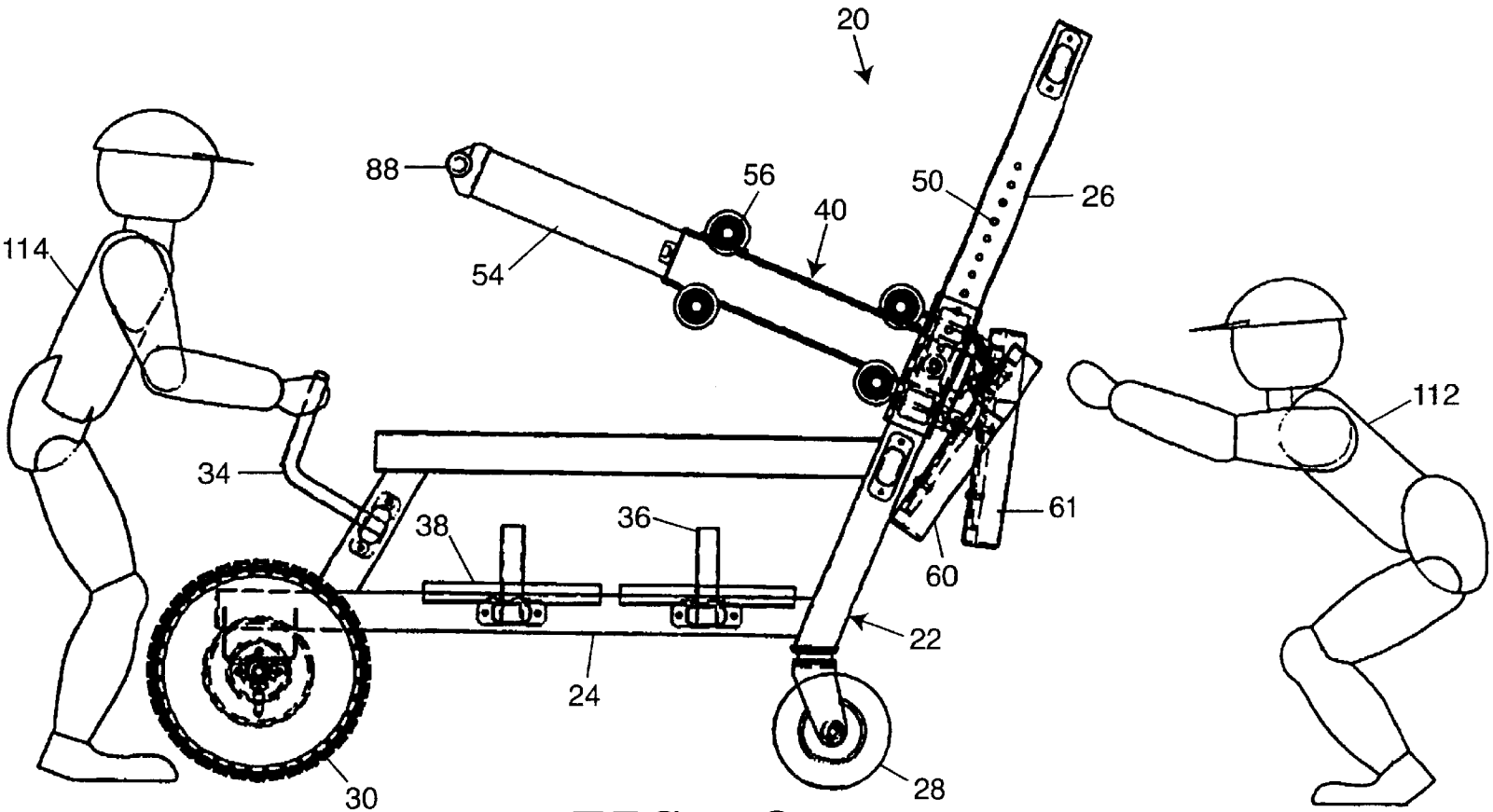
FIG. 3 is a side view of the exemplary football training apparatus of FIG. 1.

An exemplary football training apparatus 20 in accordance with the present invention will first be described in overview with respect to the illustrations thereof in FIGS. 1–3. For clarity, some of the detail of the preferred components and mechanisms for implementing a football training apparatus in accordance with the present invention are not illustrated in FIGS. 1–3. However, further detail will be provided in subsequent drawings and corresponding written description.

A football training apparatus 20 in accordance with the present invention is formed on a frame structure 22. The frame structure 22 has two basic components, a generally horizontally oriented base 24, and a generally vertically oriented extending portion 26, extending generally vertically from the base 24 at a front end thereof. As illustrated, the vertically extending portion 26 may extend both vertically and forward from the front end of the horizontal base 24 of the frame structure 22 at a slight angle, e.g., approximately 20°–30°, from vertical. Note that the frame structure 22, including the horizontal base 24 and vertical extension 26, may be formed of various cross pieces which form the horizontal base 24 and vertical extension 26, which join the vertical extension 26 to the horizontal base 24, and which, in general, ensure that the frame structure 22 is sufficiently strong and stable to support the other components of the football training apparatus 20 in a sturdy and rigid manner. The various components forming the frame structure 24 may, preferably, be formed of pieces made of a strong structural material such as, for example, steel, which may be welded and/or bolted together to form the frame structure 24 in a conventional manner. The various components forming the frame structure 22 and other components of the apparatus 20 are preferably painted, coated or otherwise treated to inhibit rust, corrosion, or other environmental damage to the apparatus 20, as the entire football training apparatus 20 is preferably constructed to be used and stored both inside and outside, where the apparatus 20 may be exposed to various weather conditions.

The frame structure 22 is preferably supported by four wheels 28–31, which, for future reference, will be referred to as the front left wheel 28, the front right wheel 29, the rear left wheel 30, and the rear right wheel 31. The front wheels 28 and 29 may preferably be implemented as caster wheels with solid rubber or plastic tires which are attached at or near the front left and right corners of the frame structure 22 in a conventional manner so as to pivot around a vertically oriented axis with respect thereto. Thus, the front caster wheels 28 and 29 preferably allow for easy turning of the football training apparatus 20. The front wheels 28 and 29 of a football training apparatus 20 in accordance with the present invention are preferably freely rotatable at all times.

The rear wheels 30 and 31 of a football training apparatus 20 in accordance with the present invention are preferably larger than the front caster wheels 28 and 29, and may include treaded tires. The rear wheels 30 and 31 are preferably mounted at or near the rear of the horizontal base 24 of the frame structure 22, e.g., by a conventional axle structure 32. The rear wheels 30 and 31 preferably also incorporate brake mechanisms therein which are normally engaged to prevent rotation of the rear wheels 30 and 31 until the brake mechanisms are released. An exemplary rear wheel assembly and brake mechanism therefore will be described in more detail below. It should be understood that various types, and sizes of front 28, 29 and rear 30, 31 wheels may be employed for a football training apparatus 20 in accordance with the present invention. In a preferred embodiment, the size and type of wheels 28–31 employed are selected to allow the football training apparatus to be used both inside and outside on a variety of surfaces including, e.g., grass.

Left 34 and right 35 rear handles are preferably provided extending rearward and upward from the horizontal base portion 24 of the frame structure 22, on the opposite side thereof from the vertically extending portion 26. The rear handles 34 and 35 may be mounted to the frame structure 22 in a conventional manner, e.g., by welding or by using conventional fasteners. The rear handles 34 and 35 are preferably shaped and positioned with respect to the frame structure 22 to allow an individual positioned at the rear side of the football training apparatus to grasp the handles 34 and 35 and push the entire football training apparatus 20 in a forward direction. As will be discussed in more detail below, the rear handles 34 and 35 preferably include hand brake release mechanisms mounted thereon to release the normally engaged braking mechanisms in the corresponding rear wheels 30 and 31, respectively.

Stanchions 36, or other, similar, support structures, are preferably provided on the horizontal base portion 24 of the frame structure 22 for supporting conventional weight plates 38 which may, thereby, be easily loaded onto and removed from the frame structure 22. Weights 38 may be added to and removed from the stanchions 36 to alter the weight of the football training apparatus to accommodate athletes of various strength levels which may use the football training apparatus for pushing exercises, and to simulate opposing players of various sizes, as will be discussed in more detail below.

An actuator system assembly 40 is mounted to the vertically extending portion 26 of the frame structure 22. The actuator system assembly 40 will now be described in more detail with reference to FIGS. 4 and 5. The actuator system assembly 40 includes an actuator system support structure 42. The actuator system support structure 42 is the structure by which the actuator system assembly 40 is attached to the vertically extending portion 26 of the frame structure 22. The actuator system support structure 42 also provides support for the other components of the actuator system assembly 40, as will be discussed in more detail below.

Figure 4:
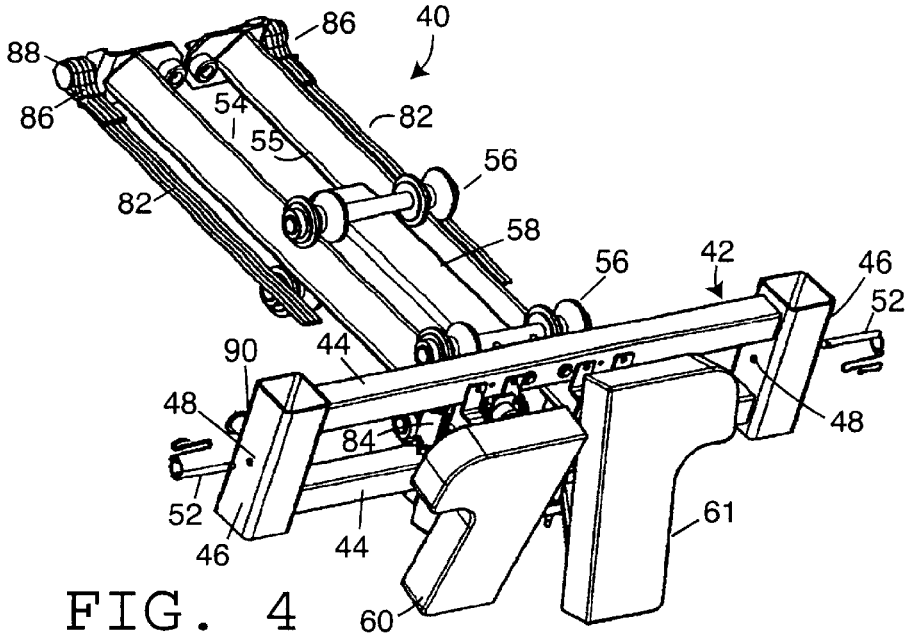
FIG. 4 is a front perspective view of an exemplary brake actuator system assembly for a football training apparatus in accordance with the present invention.

As illustrated in FIG. 4, for example, the actuator system support structure 42 may include horizontally oriented cross pieces 44. Attached to the ends of the cross pieces 44 are left and right vertically oriented sleeve structures 46. The actuator system support structure 42 may be formed, e.g., of steel or another structural material, with, for example, the cross-pieces 44 securely welded to the end sleeves 46. The end sleeves 46 are sized and shaped to fit around corresponding left and right posts forming the sides of the vertically extending portion 26 of the frame structure 22. A slight clearance is provided between the interior surfaces of the sleeves 46 and the outer surface of the side posts of the vertically extending portion 26 of the frame structure 22, such that the actuator system support structure 42 and, therefore, the entire actuator system assembly 40, may be slid up and down in position on the vertically extending portion 26 of the frame structure 22, thereby to adjust the height of the actuator system 40 with respect to the frame structure 22.

Apertures 48 are formed in the sleeve ends 46 of the actuator system support structure 42. The apertures 48 formed in the sleeves 46 are positioned thereon to be aligned with corresponding apertures 50 formed in the vertically extending portion of 26 of the frame structure 22 to which the actuator system assembly 40 is mounted. A plurality of such apertures 50 are formed at intervals along the length of the vertically extending portion 26 of the frame structure 22. The height of the actuator system assembly 40 with respect to the frame structure 22 is selected and established by aligning the apertures 48 in the sleeves 46 forming the ends of the actuator system assembly support structure 42 with corresponding apertures 50 formed in the vertically extending portion 26 of the frame structure 22 at the desired height for the actuator system assembly 40. Locking pins 52 may then be extended through the apertures 48 and 50 formed in the support structure sleeves 46 and vertically extending portion 26 of the frame structure 20, respectively, thereby to lock the actuator system assembly support structure 42 in position with respect to the vertically extending portion 26 of the frame structure 20. Preferably, the apertures 48 and 50 in the support structure sleeves 46 and vertically extending portion 26 of the frame structure 22 are formed, and the locking pins 52 are of sufficient length, such that the locking pins 52 may be extended entirely through both the support structure sleeves 46 and the side posts of the vertically extending portion 26 of the frame structure 22.

Left 54 and right 55 extending arms are movably mounted to the actuator system support structure 42. The extending arms 54 and 55 may be made of steel or another similar strong and rigid structural material. The extending arms 54 and 55 are preferably mounted close together, parallel to each other, and perpendicular to the actuator system assembly support structure 42 and to the vertically extending portion 26 of the frame 22. The movable extending arms 54 and 55 are movably mounted to the actuator system support structure 42 in a manner such that distal ends of the extending arms 54 and 55 are movable in an extending direction away from the frame 22 of the football training apparatus 20 in a forward direction and retractable toward the frame 22 of the football training apparatus 20 in a rearward direction. Moveable support of the extending arms 54 and 55 with respect to the actuator system assembly support structure 42 in this manner may be provided by a roller assembly support structure.

Figure 5:
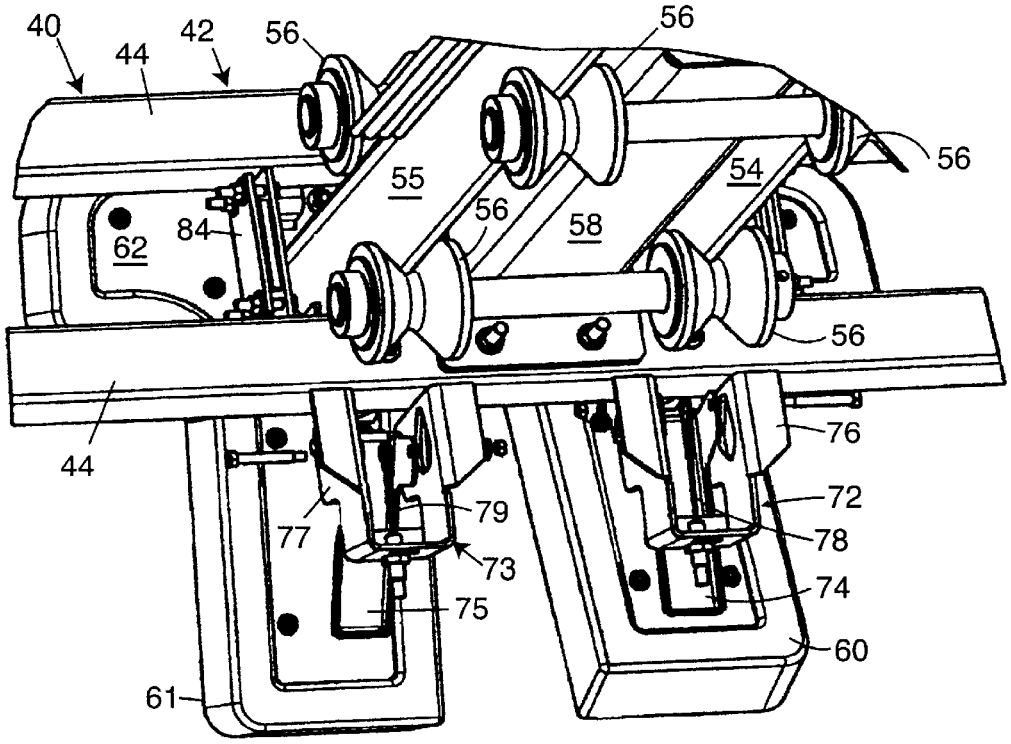
FIG. 5 is a rear perspective view showing in more detail a portion of the exemplary actuator system assembly of FIG. 4.

The roller assembly support structure may include a plurality of rollers 56 which are sized, shaped, and positioned so as to engage the extending arms 54 and 55 to provide movable support thereto in the manner described. Each of the rollers 56 is securely mounted to a roller support plate 58, or other similar structure, which, in turn, is securely bolted or otherwise attached to the actuator system assembly support structure 42. For example, as illustrated in FIG. 5, the roller support plates 58 may be securely bolted to the actuator system support structure cross pieces 44. The rollers 56, which may be made of a plastic or similar material, preferably are mounted on bearings to the support plates 58 to provide smooth roller movement. The roller support system should provide for smooth movement for the extending arms 54 and 55 with respect to the actuator system support structure 42 with minimal resistance.

Left 60 and right 61 strike pads are mounted on the distal ends of the corresponding left 54 and right 55 extending arms. The left 60 and right 61 strike pads are preferably sized and shaped, and the left 54 and the right 55 extending arms are properly spaced apart from each other, such that when the strike pads 60 and 61 are mounted to the distal ends of the extending arms 54 and 55, with the distal ends of the extending arms 54 and 55 extended by the same amount, the left 60 and right 61 strike pads mimic the torso (shoulders and body) of an opposing football player. The strike pads 60 and 61 may be formed in a conventional manner as a covered pad of foam or other compressible material mounted to a rigid backboard plate 62, made, e.g., of a rigid material such as metal or wood. The strike pad cover is preferably made of a wear and weather resistant material such as vinyl.

Figure 6:
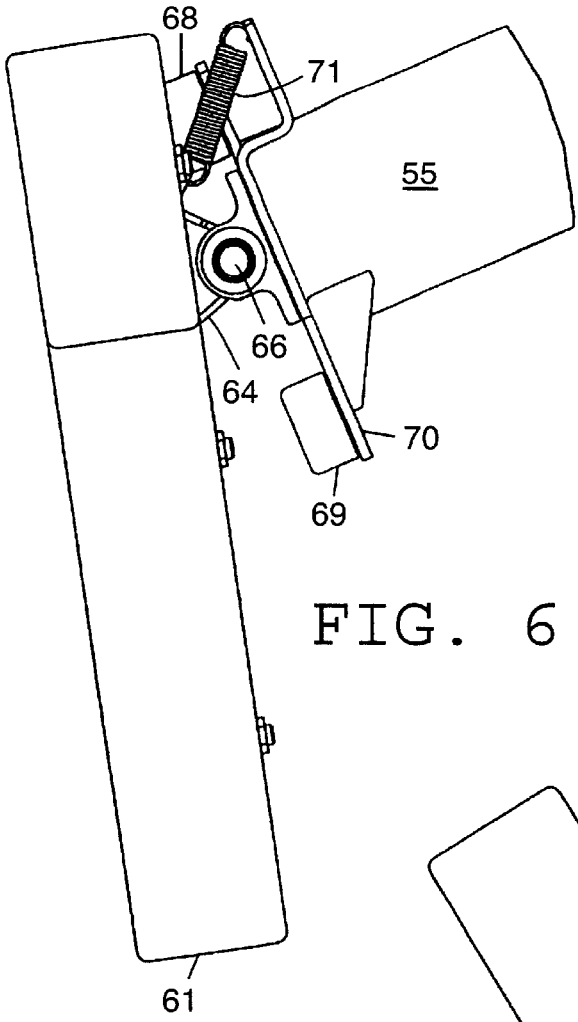
FIG. 6 is a side view of a strike pad as mounted to an extending arm of an actuator system assembly for a football training apparatus in accordance with the present invention, showing the strike pad in a position when the strike pad is not engaged by a player.
Figure 7:
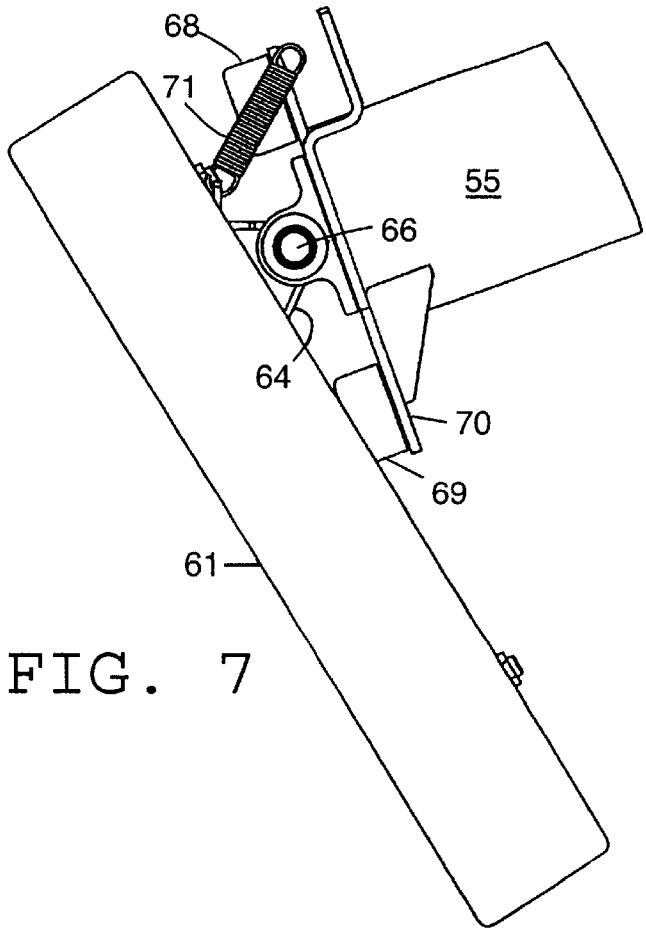
FIG. 7 is a side view of the strike pad mounted to an extending arm of an actuator system assembly as shown in FIG. 6, showing the strike pad in a fully engaged position.

As illustrated in FIGS. 6 and 7, each strike pad 60, 61 is preferably mounted to the corresponding extending arm 54, 55 for rotational movement with respect thereto about a horizontal axis. An exemplary structure for mounting the right strike pad 61 to the distal end of the corresponding right extending arm 55 is illustrated in FIGS. 6 and 7. (The structure for mounting the left strike pad 60 to the corresponding left extending arm 54 may be identical.) A hinged bracket structure 64 may be used to attach the strike pad 61 to the distal end of the extending arm 55. A part of the bracket 64 on one side of the hinge or pivot point 66 is attached to the backplate 62 of the strike pad 61. The portion of the bracket 64 on the other side of the pivot point 66 is attached to the distal end of the extending arm 55. The bracket 64 is preferably attached to the backplate 62 of the strike pad 61 near the top side thereof. Top 68 and bottom 69 strike pad stops are provided to limit the degree of rotational movement of the strike pad 61 about the pivot point 66. The top 68 and the bottom 69 strike pad stops made be made, e.g., of rubber or some other compressible or semi-compressible material, and are preferably fixedly attached to the distal end of the extending arm 55, e.g., by one or more strike pad stop bracket structures 70. The top 68 and bottom 69 strike pad stops are preferably positioned by the bracket 70 attached to the distal end of the extending arm 55 so as to contact the back plate 62 of the strike pad 61 just above and just below the attachment point of the bracket 64 thereto, thereby to limit rotation of the strike pad 61 about the pivot point 66.

In a down rotational position (as illustrated in FIG. 6), the strike pad 61 is rotated such that the strike pad back plate 62 is in contact with the top strike pad stop 68. In an up rotational position (as illustrated in FIG. 7), a player contacting the front surface of the strike pad 61 drives the back plate 62 of the strike pad 61 against the bottom strike pad stop 69. (A spring 71, or other biasing mechanism, may be provided to bias the strike pad 61 into the down rotational position when not being contacted by a player, and to provide some resistance to rotation of the strike pad 61.) The angle of rotation between the down position of the strike pad, as illustrated in FIG. 6, and the up position of the strike pad, as illustrated in FIG. 7, may be, approximately, 20°–30°. The strike pad stops 68 and 69, therefore, in combination with the position of the extending arm 55 to which they are attached by the bracket 70, establish a limited angle of rotation for the strike pad 61 such that the front surface of the strike pad 61 is oriented approximately 5° from vertical when in the down position and 35° from vertical when in the up position, as illustrated in FIGS. 6 and 7, respectively. The combined movement of the strike pad 61 upward and the extending arm 55 upward and rearward when struck simulates a player gaining leverage over an opponent. The strike pad 61 is initially positioned with a forward tilt to simulate a player in an attacking position. When the pad is engaged, it travels in an upward direction, mimicking the reversed arc line of travel that a lineman experiences while playing the game.

Left 72 and right 73 brake actuation mechanisms are provided on the actuator system assembly 40 in association with each of the left 54 and right 55 extending arms, respectively. (See FIG. 5.) Each of the left 72 and right 73 brake actuation mechanisms may include a brake actuation lever 74 or 75, respectively. Each of the left 74 and right 75 brake actuation levers may be mounted to the actuator system assembly support structure 42, e.g., to one of the support structure cross pieces 44, by a corresponding bracket 76 or 77. The brackets 76 and 77 may also provide support for one end of corresponding left 78 and right 79 brake cables. The left 74 and right 75 brake actuator levers are mounted to the corresponding left 76 and right 77 brackets for rotational movement with respect thereto. The brackets 76 and 77 position the brake actuator levers 74 and 75 such that the levers 74 and 75 will be contacted by the back plates 62 of the left 60 and right 61 strike pads, respectively, when the distal ends of the extending arms 54 and 55 to which the strike pads 60 and 61 are attached are pushed rearward into a fully retracted position. When the brake actuator levers 74 and 75 are engaged by the strike pads 60 and 61 in this manner, the levers 74 and 75 are moved with respect to the brackets 76 and 77 on which they are mounted. The brake actuator ends of the brake cables 78 and 79 are attached to the levers 74 and 75 such that the corresponding brake cables 78 and 79 are pulled when the strike pads 60 and 61 are moved so as to engage the brake actuator levers 74 and 75. As will be discussed in more detail below, pulling of the brake cables 78 and 79 by the brake actuator levers 74 and 75 in this manner acts to release brake mechanisms mounted in the left 30 and right 31 rear wheels, respectively, thereby to release the normally engaged brake mechanisms to allow rotation of the rear wheels 30 and 31 and movement of the entire apparatus 20.

A resistance mechanism biases the distal ends of the extending arms 54 and 55, to which the strike pads 60 and 61 are mounted, in a forward direction, away from the front of the training apparatus 20. The resistance mechanism resists movement of the distal ends of the extending arms 54 and 55 in a rearward direction toward the training apparatus 20. Preferably, the resistance mechanism is adjustable, to provide variable resistance for athletes of different strength attempting to push the strike pads 60 and 61 rearward toward the apparatus 20, thereby to engage the back plates 62 of the strike pads 60 and 61 against the brake actuator levers 74 and 75 to release the apparatus brake mechanisms. Such a variable resistance mechanism preferably allows more resistance to be added as a player's strength in driving the strike pads 60 and 61 rearward improves, and is preferably independently adjustable for each of the right and left sides of the apparatus. The variable resistance mechanism preferably provides a measurable quantity of resistance, such that a coach, trainer, or the player himself, may quantitatively monitor the player's improvement.

A preferred variable resistance mechanism may be implemented using elastic tension cords or bands 82, as illustrated in FIG. 4. A plurality of elastic cords 82 are provided in association with each of the left 54 and right 55 extending arms. One end of the cords 82 (not shown in the Figures) may be fixedly attached to the actuator system assembly support structure 42. For example, one end of the cords 82 may be fixedly attached to the support structure between plates 84, by brackets, or by another similar structure, attached to the actuator system assembly support structure 42, e.g., between the support structure cross pieces 44 (See FIG. 5). The ends of the elastic tension cords 82 opposite the ends thereof which are fixedly attached to the support structure 42 may include loops 86 formed thereon. The looped ends 86 of the resistance cords 82 are adapted to be removably attachable to proximal ends of the extending arms 54 and 55, e.g., by posts 88 or other structures provided extending from the proximal ends of the extending arms 54 and 55. The cord posts 88 are sized and shaped, and the lengths of cords 82 are selected, such that the looped ends 86 of the cords 82 are easily placed around the posts 88 when the extending arms are in their fully extended position, and the looped ends 86 of the cords 82 are prevented from slipping off of the posts 88 as the extending arms 54 and 55 are driven rearward by a player or players contacting the strike pads 60 and 61.

Each elastic tension cord 82 may provide a known amount of resistance, e.g., 150 pounds per cord. As a player's strength improves, by using the football training apparatus 20 of the present invention, additional cords 82 may be attached to each of the extending arms 54 and 55, by placing the looped ends 86 of the desired number of cords around the corresponding cord posts 88. Since the resistance provided by each cord 82 is known, a player's ability to drive the extending arms 54 and 55 rearward, until the strike pads 60 and 61 engage the corresponding brake actuator levers 74 and 75, can be quantitatively determined from the number and resistance of the cords attached to the extending arms 54 and 55 during performance of the exercise. Additional posts 90 may be provided on the actuator system assemble support structure 42, to which the looped ends 86 of cords 82 not attached to the posts 88 provided on the proximal ends of the arms 54 and 55 may be attached, to prevents such cords 82 which are not currently in use from interfering with operation of the actuator system 40.

Figure 8:
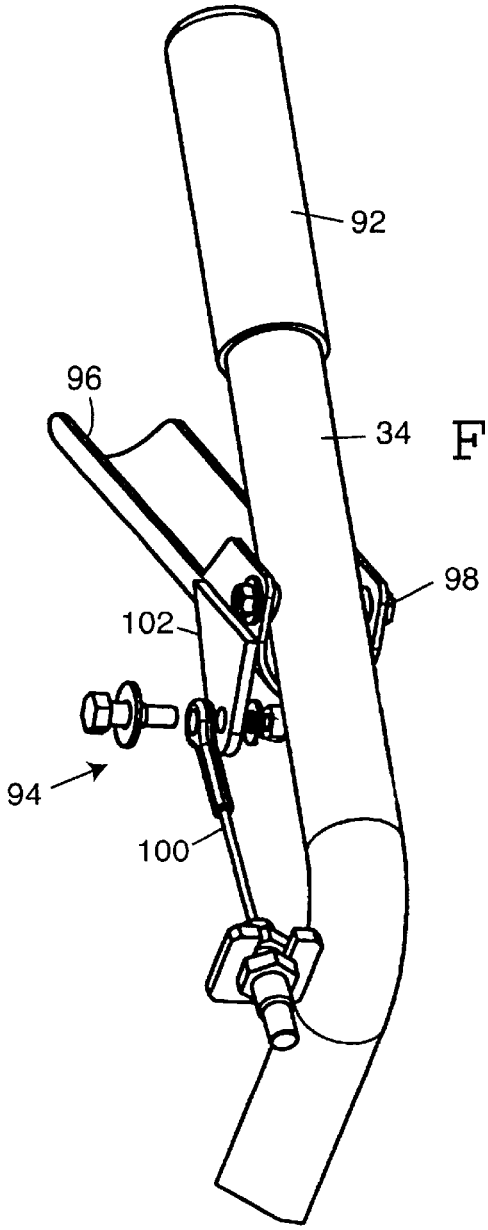
FIG. 8 is a partially exploded perspective view of an exemplary hand brake release mechanism for a football training apparatus in accordance with the present invention.

A more detailed view of an exemplary end of one of the handles 34 mounted to the rear of the frame structure 22 is illustrated in FIG. 8. (The left rear handle 34 is shown in FIG. 8, the right rear handle 35 may be implemented similarly.) The rear handle 34 may preferably include a grip 92, which may be attached to or formed on the end of the handle 34. The grip 92 may be formed in a conventional manner of a compressible or semi-compressible material such as plastic, foam, or rubber. A hand brake release mechanism 94 is preferably mounted on the handle 34 near the grip 92 end thereof. For example, the brake release mechanism 94 may include a hand brake release lever 96 mounted for rotational movement to the handle 34 at a pivot point 98. A hand brake release cable 100 is attached to an extending portion 102 of the brake release lever 96. The extending portion 102 of the hand brake release lever 96 operates as a cam such that as the hand brake release lever 96 is rotated about the pivot point 98, toward the handle 34, the extending portion 102 of the brake lever operates to pull the band brake release cable 100. As will be discussed in more detail below, the hand brake release cable 100 is coupled to a brake mechanism in the left rear wheel 30, to release the normally engaged braking mechanism therein when the brake cable 100 is pulled by actuation of the hand brake release lever 96. Preferably, separate hand brake release mechanisms 94 are provided on each of the left 34 and right 35 rear handles attached to the rear of the frame structure 22, thereby to operate independently brake mechanisms in each of the left 30 and right 31 rear wheels, respectively. The hand brake release mechanism 94 is preferably positioned on the handle 34 such that hand brake release lever 96 may be easily operated by an individual grasping the handle 34 by the grip 92 portion thereof.

Figure 10:
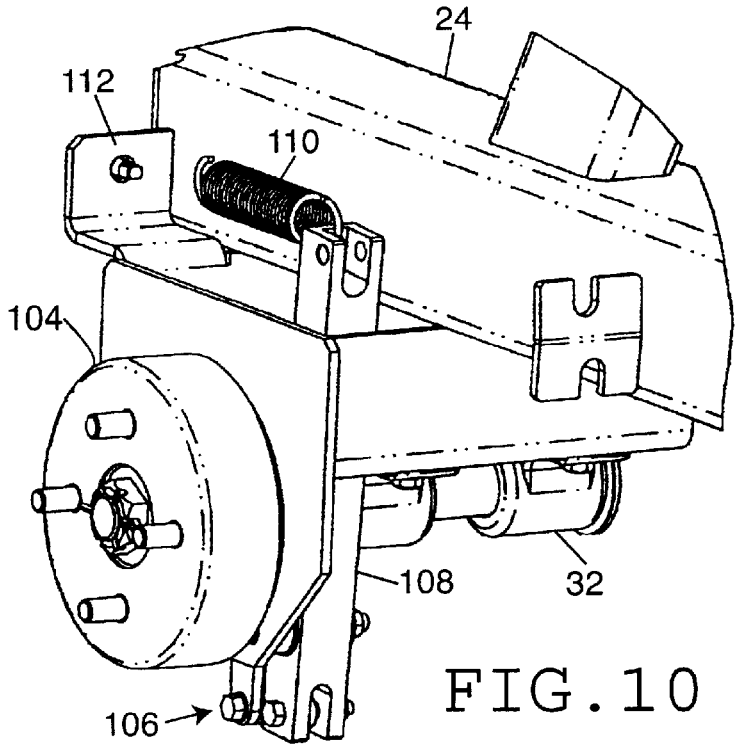
Figure 11:
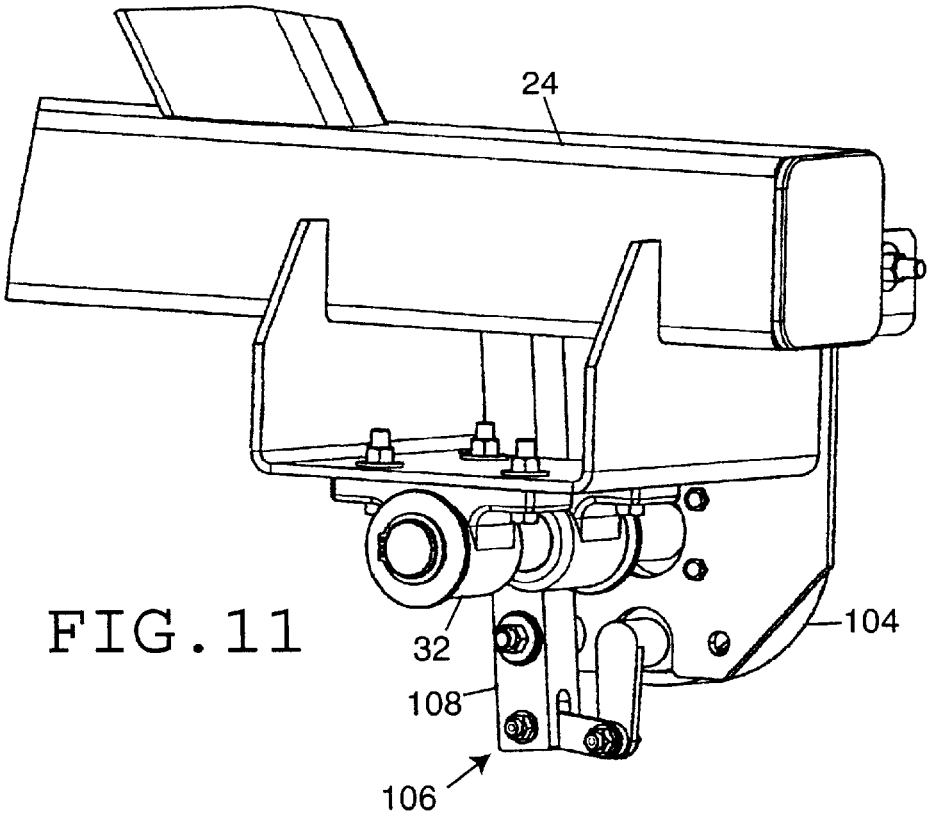

A brake mechanism associated with the left rear wheel 30 of the exemplary embodiment of a football training apparatus 20 in accordance with the present invention being described will now be described in additional detail with reference to FIGS. 9, 10 and 11. (An independently operated braking mechanism of the same type may be employed for the right rear wheel 31 as well.) The rear wheel 30 may be mounted on a rotatable wheel drum 104 which, in turn, is mounted to the frame structure 22, specifically, to the horizontal base portion 24 of the frame structure 22, via the axle assembly 32. The axle assembly 32 includes a bearing support structure for an axle supporting the wheel drum 104, which allows free and smooth rotation thereof and, therefore, of the wheel 30 attached to the drum 104. A cam type brake pad (not shown) is disposed within the wheel drum 104 adjacent an inner peripheral surface thereof. The brake pad within the wheel drum 104 is couple by a mechanism 106 to a lever 108 such that when the lever 108 is moved in a first direction the brake pad within the wheel drum 104 is pressed against the inner peripheral surface of the wheel drum 104 to prevent rotation thereof. In this state, the brake mechanism is said to be engaged. When the lever 108 is moved in an opposite second direction, the brake pad is pulled away from the inner peripheral surface of the wheel drum 104, thereby allowing free rotation of the wheel drum 104. In this state, the brake mechanism is said to be released.

A spring 110, or other biasing mechanism, is preferably attached to an end of the lever 108 opposite the end thereof which is coupled to the mechanism 106. The spring 110, or other mechanism, biases the lever 108 in the first direction, such that the braking mechanism is maintained in a normally engaged state. (Note that the end of the spring 110 which is not attached to the lever 108 may be attached in a fixed position to an extending portion 112 of a bracket attached to the horizontal base portion 24 of the frame structure 22. The spring end is shown detached from this bracket 112 in FIGS. 9 and 10.)

Figure 9:
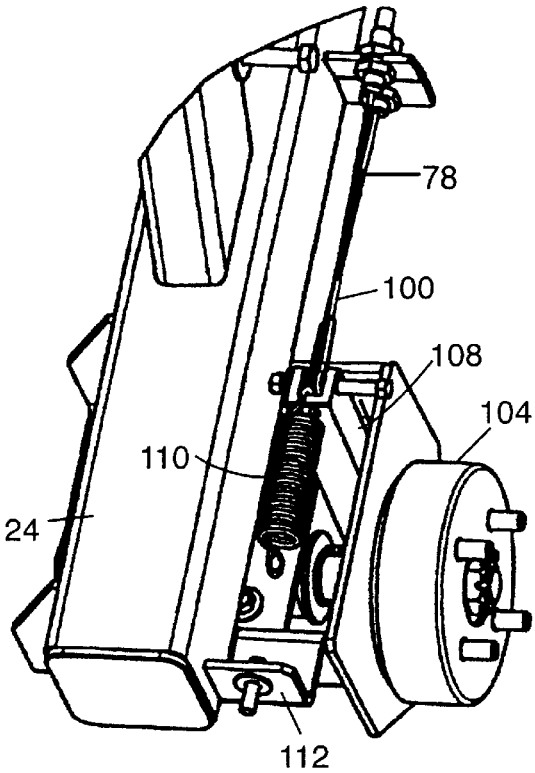
FIGS. 9–11 are various perspective views of a portion of a wheel assembly for a football training apparatus in accordance with the present invention, showing in detail an exemplary brake mechanism therefore.

As illustrated in FIG. 9, the brake cables 78 and 100, from the brake actuation mechanism 72 in the actuator system assembly 40 and the hand brake release mechanism 94 mounted on the rear handle 34, respectively, are coupled to the same end of the lever 108 as the biasing spring 10. The brake cables 78 and 100 are attached to this end of the lever 108 so as to operate against the operation of the biasing spring 110 when the cables 78 or 100 are pulled by operation of the brake actuator lever 74 or hand brake release lever 96, as discussed previously. If either the brake actuator lever 74 in the brake actuation mechanism 72 or the hand brake release lever 96 is actuated, corresponding brake cable 78 or 100 will pull the lever 108 against the bias of the spring 110 in the second direction, thereby releasing the brake mechanism to allow free rotation of the wheel drum 104 and the rear wheel 30 attached thereto. Thus, either rear wheel 30 or 31 may be released from a state where the braking mechanism is normally engaged to prevent rotation of the wheel by either driving the corresponding strike pad 60 or 61 rearward so as to engage the corresponding brake actuator lever 74 or 75, or by operation of the hand brake release lever 96 provided on either of the left 34 or right 35 rear handles. When both the brake actuator lever 74 or 75 and brake release lever 96 are released, the biasing spring 110 will pull the lever 108 in the second direction, thereby returning the brake mechanism (in either the left 30 or right 31 rear wheel) to the normally engaged state, thereby preventing rotation of the rear wheels 30 and 31 and, therefore, movement of the football training apparatus 20.

A football training apparatus 20 in accordance with the present invention may be used in many ways as a functional strength machine to increase a player's strength and endurance, particularly as specifically applied to blocking. To use the apparatus 20, the apparatus 20 is positioned on a surface which may be indoor or outdoor, grass, artificial turf, etc. The height of the actuator system assembly 40 with respect to the vertically extending portion 26 of the frame structure 22 is selected such that the strike pads 60 and 61 are at an appropriate height for a player 112 who will be using the apparatus 20. The height of the actuator system assembly 40 may be adjusted in the manner described above, by sliding the sleeve ends 46 of the actuator system assembly support structure 42 either up or down to an appropriate position on the side posts of the vertically extending portion 26 of the frame 22 until the strike pads 60 and 61 are at the desired height and the apertures 48 in the support structure end sleeves 46 are aligned with corresponding apertures 50 in the side posts of the vertically extending portion 26 of the frame 22. The lock pins 52 are then extended through the aligned apertures 48 and 50 in the actuator system assembly support structure end sleeves 46 and the side posts of the vertically extending portion 26 of the frame 22, thereby to lock the actuator system assembly 40 into the desired position. A selected number of elastic tension cords 82 are attached to each of the left 54 and right 55 extending arms, by attaching the looped ends 86 of the selected number of cords 82 to the attachment posts 88 formed at the proximal ends of the extending arms 54 and 55. An appropriate number of tension cords 82, providing an appropriate degree of resistance force to movement of the extending arms 54 and 55 in a rearward direction, are selected as appropriate for the strength of the player 112 using the device.

The player 112 may then drive forward from a standing or down or set position, pushing on the strike pads 60 and 61 with each arm, thereby pushing the strike pads 60 and 61 into the up position and driving the extending arms 54 and 55 rearward, against the resistance force provided by the tension cords 82. With the brakes in the rear wheels 30 and 31 of the apparatus 20 normally engaged, the football training apparatus 20 will not move until the extending arms 54 and 55 are driven rearward to the point where the strike pad back plates 62 engage the brake actuation mechanisms 72 and 73 to release the rear brake mechanisms. As long as the player 112 maintains sufficient force applied to the strike pads 60 and 61, the brake mechanisms will remain released, and the apparatus 20 can be pushed in a rearward direction.

This type of exercise involves numerous functional strength aspects of training. Grip strength is required to kick the strike pads 60 and 61 into the up position. Pressing strength is required to engage the strike pads 60 and 61 against the brake actuation mechanisms 72 and 73 by pushing the extending arms 54 and 55 rearward against the resistance provided by the elastic tension cords 82. Leg drive and strength are required to move the entire apparatus 20 once the brake mechanisms have been released. Stabilizer strength is required in all aspects of the machine's use. If only one of the strike pads 60 and 61 is pushed rearward sufficiently to engage the corresponding brake actuation mechanism 72 or 73, one of the rear wheels 30 or 31 will remain immobile, and the apparatus 20 will veer sideways, rather than being moved straight backward. This simulates an opposing player evading a block which is not evenly applied.

Two players may use the football training apparatus 20 of the present invention for practicing combo or deuce blocking techniques. For such an exercise, each h player strikes one of the strike pads 60 and 61. Both players must effectively drive the extending arms 54 and 55 rearward against the provided resistance to engage the brake actuation mechanisms 72 and 73 for the apparatus 20 to be pushed straight rearward. The apparatus 20 will move straight backward only if the maneuver is executed and maintained with proper coordination.

A coach or trainer 114 may position himself to the rear of the apparatus 20 to operate the hand brake release mechanisms 94 mounted on the rear handles 34 and 35 of the apparatus 20, while a player 112 or players execute a block against the strike pads 60 and 61 at the front end of the apparatus 20. The coach or trainer 114 may selectively release either or both of the left or right rear wheel brake mechanisms using the hand brake release levers 96, to release either one or both of the rear wheels 30 or 31 before the strike pads 60 and/or 61 are engaged against the brake release mechanisms 72 and 73. This simulates an opposing player responding to the player's block, to which the player being trained must respond appropriately.

A player 112 may also position himself behind the apparatus 20, grasp the apparatus by t he rear handles 34 and 35, release the brake mechanisms using the hand brake release levers 96, and push the entire apparatus 20 from the rear. Thus, the apparatus 20 can be used as a strength and speed developer by pushing the machine from the rear side thereof, without engaging the strike pads 60 and 61.

For all of the applications described, weight plates 38 may be loaded onto the stanchions 36 provided on the frame 22 to accommodate athletes of various strength levels and/or to simulate opposing players of various strength levels and/or weight.

A football training apparatus 20 in accordance with the present invention provides a quantitative functional strength machine. An amount of resistance provided against moving the extending arms 54 and 55 rearward and an amount of weight added to the apparatus 20 are both variable and quantitative. The resistance force required to drive the strike pads 60 and 61 rearward sufficiently to allow the apparatus 20 to be moved, the weight added to the apparatus 20, and the distance the apparatus 20 is driven rearward or forward in a straight line by the player 112 can all be maintained to provide quantitative measures of a player's progress. Thus, a football training apparatus 20 in accordance with the present invention may be used as both a training tool and as a valuable functional rehabilitation tool. The apparatus 20 of the present invention will enable athletic trainers to evaluate quantitatively an athlete's progress and develop confidence prior to returning to drills and play.

It should be noted that the present invention is not limited to the particular exemplary applications and embodiments illustrated and described herein, but embraces all variations thereof which come within the scope of the following claims. For example, although it is preferred that a football training apparatus have separate independently operable extending arms 54 and 55, strike pads 60 and 61, and corresponding brake mechanisms, a football training apparatus in accordance with the present invention may be implemented with a single strike pad, extending arm, and brake mechanism. Furthermore, a football training apparatus in accordance with the present invention may be mounted on a sled or track rather than on wheels. In such a case, a braking mechanism preventing movement of the apparatus frame along the track or with respect to the ground may be employed.

What is claimed is:

1. A football training apparatus, comprising:

(a) a frame structure;

(b) a brake mechanism preventing movement of the frame structure when engaged and allowing movement of the frame structure when released;

(c) a moveable arm extending from the frame structure and mounted on the frame structure such that a distal end of the moveable arm is moveable in a direction toward the frame structure;

(d) a strike pad mounted on the distal end of the moveable arm;

(e) a brake actuator mechanism coupled to the brake mechanism and adapted to release the brake mechanism when the distal end of the moveable arm is moved in a direction toward the frame structure by more than a selected amount; and (f) a resistance mechanism including at least one elastic tension band opposing movement of the distal end of the moveable arm in a direction toward the frame structure.

2. The football training apparatus of claim 1 wherein the moveable arm is mounted on the frame structure such that a height of the moveable arm with respect to the frame structure is adjustable.

3. The football training apparatus of claim 1 wherein the frame structure includes a base frame structure and a vertically extending frame structure extending in a substantially vertical direction from a front end of the base frame structure, and wherein the moveable arm is mounted to the vertically extending frame structure and extends therefrom in a direction away from the frame structure.

4. The football training apparatus of claim 3 wherein the vertically extending frame structure extends both vertically and horizontally away from the front end of the base frame structure.

5. The football training apparatus of claim 1 comprising additionally a plurality of wheels supporting the frame structure.

6. The football training apparatus of claim 5 wherein the brake mechanism prevents rotation of at least one of the wheels when engaged and allows rotation of the at least one of the wheels when released.

7. The football training apparatus of claim 1 wherein the brake actuator mechanism includes a brake lever coupled to the brake mechanism by a brake cable such that the brake lever releases the brake mechanism when the brake lever is actuated, and wherein the brake lever is positioned adjacent to the moveable arm such that the strike pad engages the brake lever to actuate the brake lever when the distal end of the moveable arm is moved in a direction toward the frame by more than a selected amount.

8. The football training apparatus of claim 1 wherein the moveable arm is mounted on the frame structure such that the distal end thereof extends from a front end of the frame structure in a direction away from the frame structure, and comprising additionally at least one rear handle mounted to a rear end of the frame structure opposite the front end thereof and a hand operated brake release mechanism coupled to the brake mechanism and mounted on the rear handle.

9. The football training apparatus of claim 1 wherein the resistance mechanism includes a variable number of elastic tension bands connected to the moveable arm.

10. The football training apparatus of claim 1 comprising additionally at least one stanchion attached to the frame structure for supporting a plurality of weight plates thereon.

11. The football training apparatus of claim 1 wherein the strike pad is mounted on the distal end of the moveable arm for rotational movement with respect thereto about a horizontal axis.

12. A football training apparatus, comprising:

(a) a frame structure;

(b) left and right wheels supporting the frame structure;

(c) independent left and right brake mechanisms preventing movement of the left and right wheels respectively when engaged and allowing movement of the left and right wheels respectively when released;

(d) independent left and right moveable arms extending from the frame structure and mounted on the frame structure such that distal ends of the left and right moveable arms are independently moveable in a direction toward the frame structure and away from the frame structure;

(e) left and right strike pads mounted on the distal ends of the left and right moveable arms respectively;

(f) independent left and right brake actuator mechanisms coupled to the left and right brake mechanisms respectively, wherein the left brake actuator mechanism is adapted to release the left brake mechanism when the distal end of the left moveable arm is moved in a direction toward the frame structure by more than a selected amount, and wherein the right brake actuator mechanism is adapted to release the right brake mechanism when the distal end of the right moveable arm is moved in a direction toward the frame structure by more than a selected amount; and (g) resistance mechanisms opposing movement of the distal ends of the left and right moveable arms in a direction toward the frame structure.

13. The football training apparatus of claim 10 wherein the left and right moveable arms are mounted on the frame structure such that a height of the moveable arms with respect to the frame structure is adjustable.

14. The football training apparatus of claim 10 wherein the frame structure includes a base frame structure and a vertically extending frame structure extending in a substantially vertical direction from a front end of the base frame structure, and wherein the left and right moveable arms are mounted to the vertically extending frame structure and extend therefrom in a direction away from the frame structure.

15. The football training apparatus of claim 14 wherein the vertically extending frame structure extends both vertically and horizontally away from the front end of the base frame structure.

16. The football training apparatus of claim 10 wherein the left and right wheels are rear wheels and comprising additionally at least one front caster wheel supporting the frame structure.

17. The football training apparatus of claim 12 wherein the left brake actuator mechanism includes a left brake lever coupled to the left brake mechanism by a left brake cable such that the left brake lever releases the left brake mechanism when the left brake lever is actuated, wherein the right brake actuator mechanism includes a right brake lever coupled to the right brake mechanism by a right brake cable such that the right brake lever releases the right brake mechanism when the right brake lever is actuated, and wherein the left brake lever is positioned adjacent to the left moveable arm such that the left strike pad engages the left brake lever to actuate the left brake lever when the distal end of the left moveable arm is moved in a direction toward the frame structure by more than a selected amount, and the right brake lever is positioned adjacent to the right moveable arm such that the right strike pad engages the right brake lever to actuate the right brake lever when the distal end of the right moveable arm is moved in a direction toward the frame structure by more than a selected amount.

18. The football training apparatus of claim 12 wherein the left and right moveable arms are mounted on the frame structure such that the distal ends thereof extend from a front end of the frame structure in a direction away from the frame structure, and comprising additionally left and right rear handles mounted to a rear end of the frame structure opposite the front end thereof, a left hand operated brake release mechanism coupled to the left brake mechanism and mounted on the left rear handle, and a right hand operated brake release mechanism coupled to the right brake mechanism and mounted on the right rear handle.

19. The football training apparatus of claim 12 wherein the resistance mechanisms are adjustable to adjust forces opposing movement of the distal ends of the moveable arms in a direction toward the frame structure.

20. The football training apparatus of claim 12 wherein the resistance mechanisms includes at least one elastic tension band.

21. The football training apparatus of claim 20 wherein the resistance mechanisms include a variable number of elastic tension bands connected to each of the left and right moveable arms.

22. The football training apparatus of claim 12 comprising additionally at least one stanchion attached to the frame structure for supporting a plurality of weight plates thereon.

23. The football training apparatus of claim 12 wherein the left and right strike pads are mounted on the distal ends of the left and right moveable arms respectively for rotational movement with respect thereto about a horizontal axis.

24. The football training apparatus of claim 23 comprising additionally strike pad stops mounted on the distal ends of the left and right moveable arms in positions thereon to limit the rotational movement of the left and right strike pads.

25. The football training apparatus of claim 12 wherein the left and right strike pads are sized and shaped such that the left and right strike pads together mimic a torso of a football player.

26. A football training apparatus, comprising:

(a) a frame structure;

(b) left and right wheels supporting the frame structure;

(c) independent left and right brake mechanisms preventing movement of the left and right wheels respectively when engaged and allowing movement of the left and right wheels respectively when released;

(d) independent left and right moveable arms extending from the frame structure and mounted on the frame structure such that distal ends of the left and right moveable arms are independently moveable in a direction toward the frame structure and away from the frame structure;

(e) left and right strike pads mounted on the distal ends of the left and right moveable arms respectively for rotational movement with respect thereto about a horizontal axis;

(f) independent left and right brake actuator mechanisms coupled to the left and right brake mechanisms respectively, wherein the left brake actuator mechanism is adapted to release the left brake mechanism when the distal end of the left moveable arm is moved in a direction toward the frame structure by more than a selected amount, and wherein the right brake actuator mechanism is adapted to release the right brake mechanism when the distal end of the right moveable arm is moved in a direction toward the frame structure by more than a selected amount; and (g) means for biasing the left and right strike pads into first rotational positions.

27. A football training apparatus, comprising:

(a) a frame structure;

(b) a brake mechanism preventing movement of the frame structure when engaged and allowing movement of the frame structure when released;

(c) a moveable arm extending from the frame structure and mounted on the frame structure such that a distal end of the moveable arm is moveable in a direction toward the frame structure;

(d) a strike pad mounted on the distal end of the moveable arm for rotational movement with respect thereto about a horizontal axis;

(e) a brake actuator mechanism coupled to the brake mechanism and adapted to release the brake mechanism when the distal end of the moveable arm is moved in a direction toward the frame structure by more than a selected amount;

(f) strike pad stops mounted on the distal end of the moveable arm in positions thereon to limit the rotational movement of the strike pad; and (g) a resistance mechanism including at least one elastic tension band opposing movement of the distal end of the moveable arm in a direction toward the frame structure.

28. A football training apparatus, comprising:

(a) a frame structure;

(b) a brake mechanism preventing movement of the frame structure when engaged and allowing movement of the frame structure when released;

(c) a moveable arm extending from the frame structure and mounted on the frame structure such that a distal end of the moveable arm is moveable in a direction toward the frame structure;

(d) a strike pad mounted on the distal end of the moveable arm for rotational movement with respect thereto about a horizontal axis;

(e) a brake actuator mechanism coupled to the brake mechanism and adapted to release the brake mechanism when the distal end of the moveable arm is moved in a direction toward the frame structure by more than a selected amount;

(f) means for biasing the strike pad into a first rotational position; and (g) a resistance mechanism including at least one elastic tension ban opposing movement of the distal end of the moveable arm in a direction toward the frame structure.

* * * * *

UNITED STATES PATENT AND TRADEMARK OFFICE

CERTIFICATE OF CORRECTION

PATENT NO. : 6,761,650 B1
DATED : July 13, 2004
INVENTOR(S) : John E. Dettman

It is certified that error appears in the above-identified patent and that said Letters Patent is hereby corrected as shown below:

Column 12,
Line 23, “biasing spring 10” should be -- biasing spring 110 --.

Column 13,
Line 41, “each h player” should be -- each player --.

Column 16,
Lines 1, 5 and 17, for the claim reference numeral “10”, each occurrence should read -- 12 --.

Column 18,
Line 41, “ban” should be -- band --.

Signed and Sealed this

Seventh Day of September, 2004

JON W. DUDAS
*Director of the United States Patent and Trademark Office*